United States Patent [19]

Palma

[11] 4,149,496

[45] Apr. 17, 1979

[54] THROTTLE BODY INJECTION APPARATUS

[75] Inventor: James D. Palma, Grand Rapids, Mich.

[73] Assignee: General Motors Corporation, Detroit, Mich.

[21] Appl. No.: 862,737

[22] Filed: Dec. 21, 1977

[51] Int. Cl.[2] ..... F02M 32/00

[52] U.S. Cl. ..... 123/32 AE; 123/28; 123/119 A; 123/139 AW; 261/116; 261/DIG. 39

[58] Field of Search ..... 123/32 AE, 28, 32 F, 123/32 J, 130, 131, 41.31, 41.32, 119 A, 119 R, 139 AW, 139 AN, 139 AL, 139 AS, 139 AT; 261/DIG. 39, 116

[56] References Cited

U.S. PATENT DOCUMENTS

| | | | |
|---|---|---|---|
| 2,898,895 | 8/1959 | Köppel et al. | 123/41.31 |
| 3,590,789 | 7/1971 | Wiebicke | 123/41.31 |
| 3,635,201 | 1/1972 | High | 123/139 AW |
| 3,717,130 | 2/1973 | Thornburgh | 123/119 A |
| 3,717,131 | 2/1973 | Chana et al. | 123/119 A |
| 3,747,901 | 7/1973 | Coverston | 261/116 |
| 3,767,176 | 10/1973 | Engalitcheff, Jr. et al. | 261/116 |
| 3,943,904 | 3/1976 | Byrne | 123/28 |

*Primary Examiner*—Charles J. Myhre

*Assistant Examiner*—R. A. Nelli

*Attorney, Agent, or Firm*—Arthur N. Krein

[57] ABSTRACT

In a throttle body injection apparatus of the type having a throttle body housing including a throttle body portion with spaced apart valve controlled throttle bores therein and a fuel body operatively connected to the throttle body portion, the fuel body is of substantially open, diamond like configuration and has a pair of socket cavities therein adjacent opposite corners thereof with electromagnetic fuel injectors positioned therein to discharge fuel from spray tip ends of the injectors into the throttle bores upstream of the valves therein, each electromagnetic fuel injector forming with a socket cavity an annular fuel chamber in flow communication with opposed inlet and outlet ports of the injector, the fuel body having a support port at one apex thereof connectable to a source of low pressure fuel and a drain port at the opposite apex thereof connectable to a fuel drain conduit, the fuel body having inlet passages therein connecting the supply port to the fuel chambers, and drain passages therein connecting the drain port to the fuel chambers, the axis of these ports and passages forming a diamond like flow path outline for the ingress and egress of fuel to and from the fuel chambers in the fuel body.

3 Claims, 5 Drawing Figures

THROTTLE BODY INJECTION APPARATUS

This invention relates to internal combustion engines and, in particular, to a throttle body injection apparatus for supplying low pressure fuel and air into the intake manifold of a gasoline engine.

DESCRIPTION OF THE PRIOR ART

Various types of so called pressurized carburetor system have been proposed in the past for supplying an induction air/fuel mixture to an engine. One such type pressurized carburetor system is in effect a type of fuel injection system wherein one or two electromagnetic fuel injectors are positioned at a common point to supply fuel into the induction system for the engine so that the resulting air fuel mixture can be supplied by the usual intake manifold to all of the cylinders of the engine.

Because of the high volatility of gasoline at low pressure and at elevated temperatures and altitudes, most such prior art fuel injection systems have required the use of a relatively high pressure pump, such as a gear pump, for use in supplying the injectors of such a system with fuel at a pressure of approximately 40 pounds per square inch or higher in order to prevent or reduce fuel vapor problems in such a system, since otherwise the presence of fuel vapor could result in vapor lock or the loss of power during engine operation.

However, with the availability now of electromagnetic fuel injectors of the type disclosed in Applicant's copending U.S. patent application Ser. No. 838,468 entitled, Electromagnetic Fuel Injector, filed Oct. 3, 1977 and assigned to a common assignee, it is now possible to operate such a system with fuel supplied to the injectors at a nominal low pressure of 6 to 15 psi, for example. Thus the high pressure fuel pump which was normally used in the prior art fuel injection systems is no longer required in systems having the above type electromagnetic fuel injectors incorporated therein, it being apparent that fuel at such a low supply pressure can be provided, for example, by an inexpensive in-tank fuel supply pump.

This latter type fuel injection system may be referred to a a throttle body injection system and the fuel/air mixing element thereof, a throttle body injection apparatus. However, in order for such apparatus to function properly with normal variations in ambient temperature and atmospheric pressure, the apparatus must be capable of use with low pressure gasoline fuel in a manner so as to prevent or reduce fuel vapors in the apparatus.

SUMMARY OF THE INVENTION

The present invention relates to a throttle body injection apparatus for use with a gasoline engine, the throttle body injection apparatus having a throttle body housing which includes a throttle body having a pair of spaced apart throttle bores therein with the flow therethrough controlled by throttle valves and a fuel body operatively associated with the throttle body. The fuel body, which also functions as an injector holder, is of open diamond shape configuration and is provided with spaced apart through socket cavities at opposed corners thereof in which a pair of electromagnetic fuel injectors are mounted for injecting fuel into the throttle bores above the throttle valves therein, these injectors, as mounted in the cavities, define therewith fuel chambers each of which is in communication with the fuel supply and drain ports of its associated injector. One apex of the fuel body is provided with a fuel supply port connected by inlet passages in a connecting adjacent set of runner legs to one side of the fuel chambers while the opposite apex of the fuel body is provided with a drain port connected by drain passages in an other connecting set of runner legs of the fuel body to the opposite side of the fuel chambers.

It is therefore the primary object of this invention to improve a throttle body injection apparatus so that the fuel body of such an apparatus and the fuel flowing therethrough can be adequately cooled to reduce or eliminate the formation of fuel vapor therein.

Another object of this invention is to improve a throttle body injection apparatus by the use of an open, diamond shaped fuel body therein whereby improved cooling of the fuel body can be affected.

A still further object of this invention is to improve a throttle body injection apparatus by having the fuel body thereof constructed so that the fuel supply and drain passages therein are in spaced apart runner legs, of suitable aerodynamic shape in cross section which an open diamond shaped pattern so as to provide reduced air flow restrictions through the apparatus and to thereby improve cooling of the fuel body and of the fuel flowing therethrough by the unobstructed flow of induction air through the apparatus.

For a better understanding of the invention as well as other objects and further features thereof, reference is had to the following detailed description of the invention to be read in connection with the accompanying drawings.

DESCRIPTION OF A PREFERRED EMBODIMENT

Figure 1:
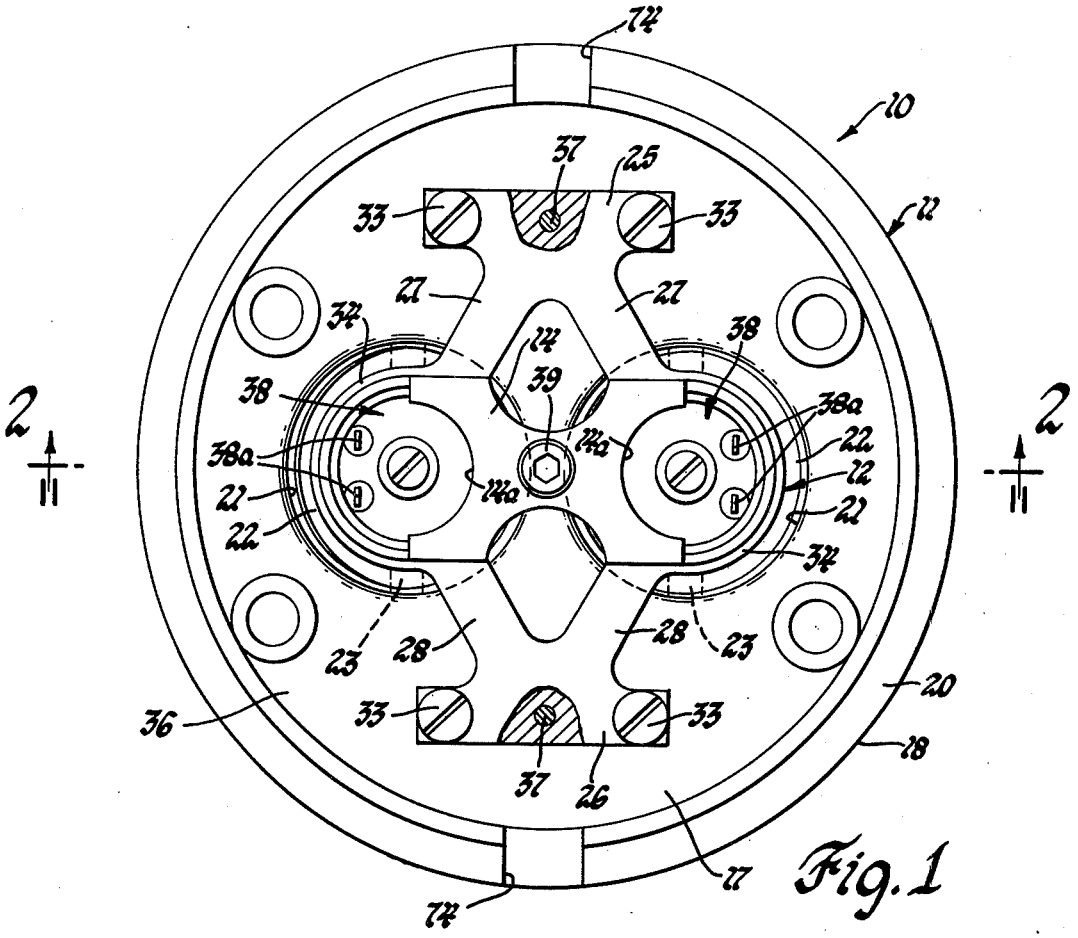
FIG. 1 is a top plan view of a preferred embodiment of a throttle body injection apparatus with its fuel body in accordance with the invention.
Figure 2:
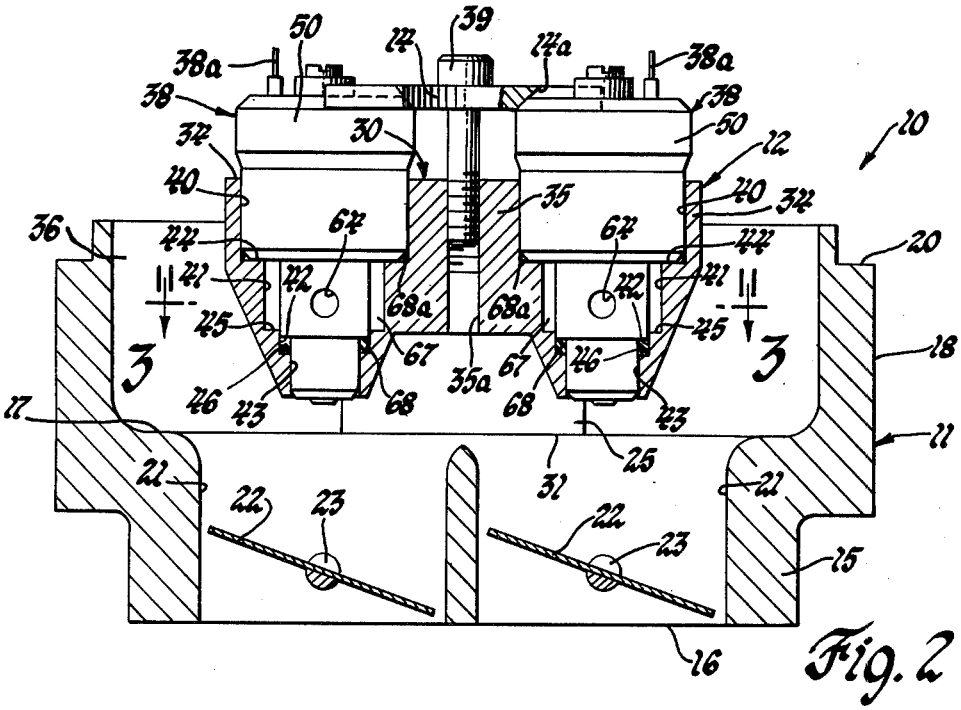
FIG. 2 is a sectional view of the throttle body injection apparatus taken along line 2—2 of FIG. 1.

Referring first to FIGS. 1 and 2, the throttle body injection apparatus 10, in accordance with the invention, includes a throttle body injection housing which for ease of manufacturing and assembly includes a throttle body 11 portion adapted to be secured to the inlet of the intake manifold for an engine, a fuel body 12 portion and an injector retainer 14.

Throttle body 11, in the construction illustrated, is of circular configuration with a base 15 having a lower flat side or surface 16 for attachment to a machined mounting pad of an engine intake manifold, not shown, or with an apertured insulating mounting plate, now shown, sandwiched therebetween, an upper surface 17 spaced from the surface 16, and an annular rim 18 extending upward from the outer peripheral edge of surface 17 to terminate at a stepped upper rim edge surface 20 onto which the lower rim of a conventional air cleaner, not shown, may be mounted.

The base 15 of throttle body 11 is provided with a pair of spaced apart throttle bores 21 extending therethrough from the upper surface 17 to lower surface 16. Flow through each of the throttle bores 21 is controlled by a throttle valve 22 suitably fixed to a valve shaft 23 that intersects the associated throttle bore and is suitably pivotably journaled in the throttle body. The throttle shafts 23 are suitably interconnected whereby the operation of the throttle valves 22 may be affected in a conventional manner not shown or described since such a throttle valve actuation mechanism forms no part of the subject invention. For the same reason, other elements, such as air flow and air temperature sensors, which may be associated with the throttle body 11 as part of the control system for the associated fuel injection system are not illustrated or described since they are not deemed necessary for an understanding of the subject invention.

Figure 3:
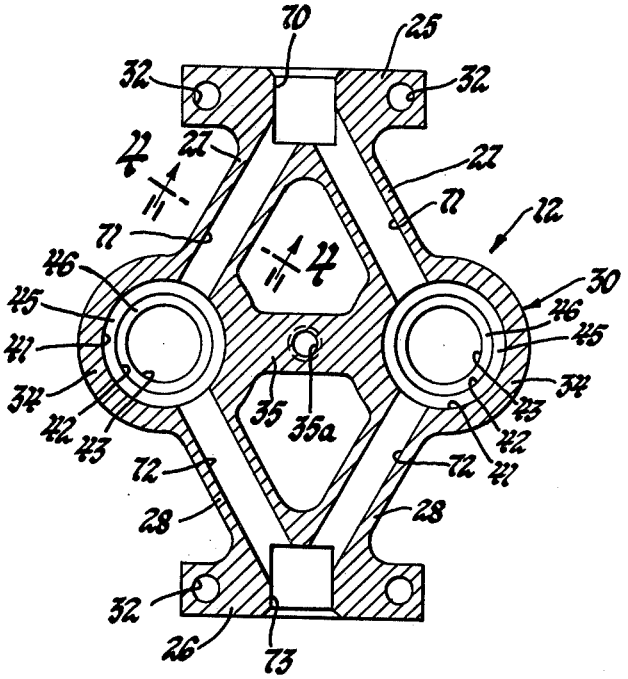
FIG. 3 is a sectional view of the fuel body, per se, of the throttle body injection apparatus taken along a line corresponding to line 3—3 of FIG. 2.

The fuel body 12, in accordance with the invention, as best seen in FIGS. 1 and 3, is of substantially open, diamond like configuration in plan view and includes first and second side bases 25 and 26, respectively, connected together in spaced apart parallel relationship to each other by first and second sets of support runner legs 27 and 28, respectively, and by an intermediate injector holder portion or body 30. Each side base 25 and 26 is provided with a flat lower support surface 31 for abutment against the upper surface 17 of the throttle body 11 and with spaced apart apertures 32 extending longitudinally therethrough to receive mounting screws 33 threaded into suitable threaded apertures, not shown, provided in the base 15 of the throttle body 11.

Each of the runner legs 27 of the first set of runners is connected at one or base end to the upper inner end of the first side base 25 while their opposite ends, which are spaced apart from each other, are connected to one side of the injector holder body 30 and, in a similar manner, each of the runner legs 28 of the second set of runners is connected at one or base end to the upper inner end of the second side base 26 while their opposite ends, also spaced apart from each other, are connected to the opposite side of injector holder body 30 from runners 27. Each of the sets of runner legs 27 and 28 is thus of V-shape and they are arranged so as to support the injector holder body 30 in cantilever fashion with the lowermost end portions thereof positioned a predetermined distance above the upper surface 17 of the base 15 of the throttle body 11, as shown in FIG. 2, for a purpose which will become apparent.

As shown, the injector holder portion or body 30 includes spaced apart, semi-circular holder portions 34 interconnected by a central web 35, the runner legs 27 and 28 being connected to the opposite sides of the holder portions 34 for a purpose which will become apparent.

Figure 4:
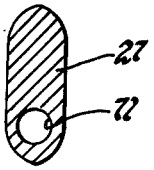
FIG. 4 is a sectional view of one of the runner legs of the fuel body taken along line 4—4 of FIG. 3; and, FIG. 5 is an enlarged sectional view of the lower nozzle portion of one of the electromagnetic fuel injectors of the throttle body injection apparatus of FIG. 1.

With the fuel body 12 of the above described configuration fixed to the throttle body 11, as described, an induction air flow passages 36 is thus provided through the throttle body 11 in the space between the inner peripheral surface of rim 18 and the exterior surfaces of the fuel body 12, with induction fluid flowing over opposite sides of the support runner legs 27 and 28, these runner legs being of suitable aerodynamic shape in cross-section, as seen in FIG. 4, to permit smooth air flow thereover. The throttle body 11 and fuel body 12 are sized so that the total cross sectional flow area of the induction flow passage 36 is preferably substantially more than twice the cross-sectional flow area through the throttle bores 21.

To provide for the injection of fuel into the air stream flowing through the throttle bores 21, two electromagnetic fuel injectors 38, of a type preferably capable of operation when supplied with fuel at a nominal low pressure of, for example, 6 to 15 psi, are supported in suitable socket cavities provided in the holder portions 34 of the fuel body 12 whereby each injector 38 is positioned to inject fuel into one of the throttle bores 21. Although the injectors 38 may be of any suitable type, in the embodiment shown, they are of the type disclosed in the above identified U.S. patent application Ser. No. 838,468.

As best seen in FIG. 2, each socket cavity is provided by a through stepped bore in the holder portions 30 of the fuel body 12, each stepped bore being located so that it is preferably concentric with an associated throttle bore 21 in the throttle body 11 and each such bore is properly sized so as to accommodate the particular injector 38 to be mounted therein. Thus in the construction illustrated, each socket cavity is defined by an annular upper wall 40, an annular intermediate wall 41, an annular lower intermediate wall 42 and an annular lower wall 43, each of which is of a predetermined inside diameter and of reduced diameter relative to the next prior described wall, with walls 40, 41 being connected by a radial shoulder or wall 44, walls 41 and 42 being connected by a radial shoulder or wall 45 and walls 42, 43 being connected by a radial shoulder or wall 46.

As shown, each socket cavity thus defined, is located substantially coaxial with its associated throttle bore 21. This alignment is obtained during assembly by suitable locating means, such as the dowel pins 37 shown in FIG. 1, which are positioned in suitable apertures, not shown, provided for this purpose in the throttle body 11 and side bases 25 and 26 of the fuel body 12.

Each electromagnetic fuel injector 38 is retained or clamped in its associated socket cavity by means of the injector retainer 14, the ends of which have suitable arcuate notches **14*a* therein to provide access to the upper elements of the injectors and, in particular, access to the electric terminals 38*a* of these injectors for connection of electrical control circuit wires, not shown, thereto of a suitable electronic control circuit of a type that is operative to energize and de-energize each of the injectors 38 as a function of engine operation in a desired manner as known in the art. In the construction shown, the injector retainer 14 is releasably secured to the fuel body 12 by means of a screw 39 extending through a suitable central aperture in the injector retainer 14 for threaded engagement in the threaded aperture 35*a* in web 35** of the fuel body.

Figure 5:
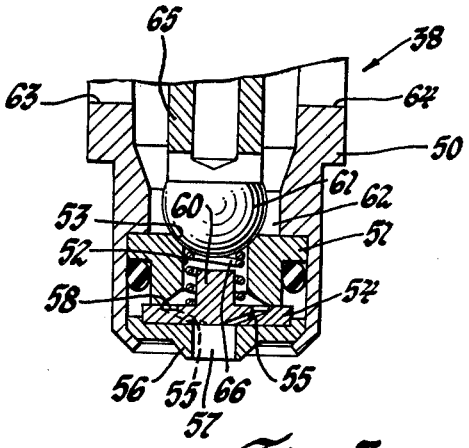

As previously described, the electromagnetic fuel injectors 38 are preferably of the type disclosed in the above identified, copending U.S. patent application Ser. No. 838,468 and, as such, would be of the type that includes a solenoid actuated valve used to control fuel flow through the nozzle assembly of such an injector. In the construction illustrated in FIG. 5, the nozzle assembly of this type electromagnetic fuel injector 38, is mounted in the lower wall nozzle case portion of the injector body 50 of the injector 38 and includes in succession, starting from the upper end of the nozzle case portion, a seat element 51 in the form of an annular disk which is provided with a central axial outlet port or flow passage 52 therethrough and with a conical valve seat 53 on its upper surface concentric with the flow passage 52, a disk like swirl director plate 54 having a plurality of circumferentially spaced apart, inclined and axially extending, director passages 55 therethrough, and a spray tip 56 with a spray orifice passage 57 therethrough.

As shown, the director passages 55 in the swirl director plate 54 extend from an annular groove 58, on the upper face of the swirl director plate 54, positioned to encircle a central upstanding boss 60 of the swirl director plate which is loosely received in the flow passage 52 through the seat element 51.

Flow through the flow passage 52 in the seat element 51 is controlled by a valve 61 loosely received within a fuel chamber 62 in the injector body that is in flow communication with the inlet and outlet ports 63 and 64, respectively, opening through the side wall of the injector body 50. Valve 61 is movable between a closed position at which it is seated against the valve seat 53 and an open or unseated position relative to the valve seat. As shown, the valve 61 is of a ball like configuration, and in the construction illustrated, is of semi-spherical shape, that is, it is a ball truncated at one end to provide a flat or plain surface on its upper side, the lower portion thereof being of ball-shaped configuration whereby it is self-centering and adapted to seat against the conical valve seat 53.

The solenoid, not shown, of the electromagnetic fuel injector 38 has a movable armature 65, which in normally spring biased, the spring not being shown, so that when the solenoid is de-energized the lower slotted end of the armature abuts against the valve 61 to move this valve to its closed position in seating engagement against the valve seat 53.

Unseating of the valve 61 from the valve seat 53, when the solenoid is energized, is effected by means of a compression valve spring 66 loosely received in the flow passage 52 of the seat element 51 to abut at one end against the upper surface of the director plate 54 and to abut at its opposite end against the lower or ball portion of the valve 61. As shown the upstanding boss 60 serves to center the spring 66 and to appreciably reduce the volume capacity available for fuel in the flow passage 52. During operation, normal seating and actuation of the valve 61 is controlled by the armature 65 of the solenoid assembly of the injector 38 and, accordingly, it will be apparent that the spring 66 only effects unseating of the valve 61 when the solenoid is energized.

Other details of this type of electromagnetic fuel injector 38 are not shown or described, since such details are not deemed necessary for an understanding of the subject invention and, since such details are fully disclosed in the above identified copending U.S. patent application Ser. No. 838,468, the disclosure of which is incorporated herein by reference thereto.

Each electromagnetic fuel injector 38 is positioned in its socket cavity so that its spray tip 56 end is located a predetermined axial spaced distance above the inlet end of the throttle bore 21 with which it is associated so that the spray cone of atomized fuel discharged therefrom will impinge on the throttle bore wall next adjacent to the upper surface 17 above the throttle valve 22, that is, on its upstream side in terms of the direction of induction fluid flow through the throttle bore.

As seen in FIG. 2, the portions of the housing of an electromagnetic fuel injector 38, including the portion thereof containing its fuel inlet port 63 and fuel outlet port 64, defines with the lower intermediate wall 42 and radial shoulder 45 of its associated cavity, an annular fuel chamber 67. Suitable O-ring seals 68 and 68*a* are used to effect seals between the injector body 50 of an electromagnetic fuel injector 38 and the adjoining wall surfaces of the socket cavity with which it is associated on opposite ends of the fuel chamber 67.

Fuel is supplied to the electromagnetic fuel injectors 38, for injection into the induction system of the engine, by a low pressure fuel supply pump, which may be an in-tank fuel pump, not shown, from the usual engine fuel tank or reservoir, not shown, via a suitable fuel supply conduit, not shown, to a fuel supply passage means in the fuel body 12 for flow to the fuel chambers 67 supplying fuel to the injectors 38, with excess fuel being returned via a fuel return or drain passage means in the fuel body 12 and a suitable return or drain conduit, having a suitable fuel pressure regulator incorporated therewith, both not shown, back to the fuel tank to mix with the fuel stored therein.

As best seen in FIG. 3, the fuel supply passage means in the fuel body 12 is provided by a common inlet port 70 in the first side base 25 that is connectable to a fuel supply conduit, as described above, and which interconnects with separate fuel inlet passages 71 in each of the runner legs 27, with each inlet passage 71 at its opposite end extending to break out on or open into one side of its associated fuel chamber 67 for flow communication therewith. In a similar manner, the fuel return or drain passage means is provided by fuel return or drain passages 72 in each of the runner legs 28, one end of each such drain passage 72 extending from its associated fuel chamber 67 on the opposite side thereof from the fuel inlet passage 71, the opposite end of each drain passage 72 opening into a common outlet port 73 that is connectable to a fuel return or drain conduit, not shown, as described above.

As shown in FIG. 3, the axes of the inlet passages 71 and drain passages 72, as they intersect at the inlet port 70 and outlet port 73, respectively, and as they would intersect in the fuel chamber 67, would form a diamond outline, that is, they form a figure having four straight sides bounding two arcuate and two obtuse angles at the apexes and corners, respectively, of this outline. Preferably, at least the inlet passages 71 are located so as to open into the associated fuel chambers 67 at a position next adjacent to the inlet port 63 of an associated injector 38 for direct flow of fuel thereto. Each injector 38, of course, is positioned in its associated socket cavity so that its inlet port 63 is substantially aligned with the associated inlet passage 71.

To permit connection of the fuel supply conduit and of the fuel drain conduit to the inlet port 70 and outlet port 73, respectively, suitable apertures are provided, for example, through a suitable portion of the throttle body 12. Thus in the construction shown in FIG. 1, the upper end portion of the rim 18 at the rim edge surface 20 thereof is provided with arcuate through notches 74 co-axially aligned with the inlet and outlet ports 70, 73, respectively, of the fuel body 11 as mounted in the throttle body 11, these notches 74 being properly sized so as to accommodate the above described conduits.

In operation the inlet port 70 of the fuel body 12 is connected to a suitable source of low pressure fuel, as previously described, with this fuel supplied at, for example, a low pressure in the range of 6 psi to 15 psi. From the inlet port 70, the fuel will flow through the inlet passages 71 into the fuel chambers 67 for flow into and through the fuel chamber 62 of the electromagnetic fuel injector 38 associated with that fuel chamber 72. The quantity of fuel delivered to the fuel chambers 67 in the fuel body 12 should be considerably in excess of that injected by the associated fuel injectors 28 into the induction system for the engine, whereby this excess fuel is operative to effect further cooling of the electromagnetic fuel injectors 38 and the fuel body 12, and to purge any fuel vapors that may form within the fuel injectors 38 from these injectors whereby the valve 61 in each injector is always covered with liquid fuel so that fuel metering is not affected. In addition, any fuel vapors that may be emitted from the fuel during its passage to the fuel chambers 67 will be carried away by the flow of excess fuel being returned to the fuel tank, not shown.

It will be apparent that any fuel vapors returned to the fuel tank may be removed therefrom, as desired, by any of the known fuel vapor recovery or evaporative emission control systems presently used in many automotive vehicles. For example, in one such system, a vapor storage canister is used to receive and store fuel vapors emitted from the fuel tank of the vehicle engine. During engine operation, the fuel vapor stored in such a canister is then purged, as controlled by a suitable purge control valve, into the induction system of the engine so that these fuel vapors can be consumed therein.

The amount of fuel supplied via the inlet port 70 for flow to the fuel chambers 67 may be as desired so that excess fuel is available to effect purging of fuel vapor from these chambers and from the interior of the injectors 38, if necessary, and to effect cooling of the fuel body 12 and the injectors mounted therein. For example, when the subject apparatus was used on a particular sized automobile internal combustion engine, the fuel flow to the fuel body 12 of the apparatus was in the range of thirty to forty-five gallons per hour. It will be apparent that only a very small amount of the fuel thus delivered is injected by the electromagnetic fuel injectors 38 into the induction system for the engine for combustion therein, the remaining fuel being the so-called excess fuel.

During operation, the electromagnetic fuel injectors 38 will inject fuel when energized or electrically pulsed and, preferably they are pulsed once per cylinder in timed relation to engine operation so as to discharge fuel into the throttle bores 21 above the throttle valves 22 whereby to provide a stoichiometric mixture to the intake manifold of the engine for distribution to the cylinders, all not shown of the engine. In operation, these injectors 38 will receive alternate pulses with possible overlap of pulses depending on engine operation, and they may be pulsed simultaneously to effect acceleration enrichment, for example, if desired.

As previously described, each electromagnetic fuel injector 38 is positioned above the throttle bore 21 with which it is associated so that during fuel injection the fuel is discharged against the wall of the throttle bore 21 above the throttle valve 22 therein at a distance equivalent to one bore diameter. Preferably each injector 38 provides a symmetrical and uniform fuel delivery into the associated throttle bore 21 and preferably the fuel is injected in a symmetric, hollow cone spray pattern onto the upper end wall of the throttle bore. Thus again referring to FIG. 5, during fuel injection, fuel flowing through each of the director passages 55 of the injector nozzle assembly is discharged into the spray orifice passage 57 thereof with an eddying or swirl motion such that this swirling movement imparted to the fuel continues as the fuel flows out of the spray orifice passage 57. Such a cone spray pattern provides proper fuel distribution around the throttle bore wall. During engine operation, the throttle valve 22 and the peripheral inner wall of the throttle bore 21 act as an accumulator or integrator to further improve the fuel flow distribution into the engine from that throttle bore so that engine-injection phasing is avoided. It will readily be appreciated that engine hydrocarbon emissions will be improved as a result of the longer fuel residence time which provides for improved fuel vaporization.

In addition with the above arrangement, by providing fuel feed through an electromagnetic fuel injector 38 at its lower end near the valve 61 and valve seat 53 with which it cooperates to meter fuel injected and by maintaining a low fuel flow velocity therethrough, the buoyancy of any fuel vapor present will leave only liquid or so called solid fuel at the metering lands of these elements. In the preferred embodiment of the electromagnetic fuel injector 38 shown, it will be apparent that fuel flow path therethrough is not torturous and in fact is a relatively open flow path whereby to permit fuel vapors to separate from the fuel in a manner so that liquid fuel is present at the lower metering end of the injector.

Although the throttle body 11 and fuel body 12 are shown as separate elements, it will be apparent that these elements could be formed as an integral throttle body injection housing having a corresponding throttle body portion and a fuel body portion, each of the type described herein.

The embodiments of the invention in which an exclusive property or privilege is claimed are defined as follows:

1. A throttle body injection apparatus for an internal combustion engine and usable with low pressure fuel, said throttle body injection apparatus including a throttle body having a throttle plate portion with two spaced apart throttle bores therethrough, a throttle valve positioned in each of said throttle bores for controlling flow therethrough, a fuel body of substantially open, diamond like configuration having a pair of through socket cavities therein intermediate the apex ends thereof and in predetermined spaced apart relationship to each other, said fuel body being secured to said throttle body with each said socket cavity positioned above, concentric with and opening at one end toward an associated said throttle bore, and a fuel injector means positioned in each said cavity, each said fuel injector means having a spray tip end positioned to discharge fuel into an associated said throttle bore above the said throttle valve associated therewith and forming with its associated said socket cavity an annular fuel chamber, said fuel body having an inlet port means at one apex end thereof connectable to a source of low pressure fuel and an outlet port means at the opposite apex end thereof connectable to a fuel return conduit, a pair of inlet passages in said fuel body connected at one end to said inlet port means and diverging outward from each other for communication at their other ends with said fuel chambers and a pair of drain passages in said fuel body connected at one end to said outlet port means and diverging outward from each other for communication at their other ends with said fuel chambers.

2. A throttle body injection apparatus for use in supplying induction fluid to a gasoline engine, said throttle body apparatus including a throttle body housing means having an induction passage therethrough with an inlet at one end for atmospheric air and an outlet means at its opposite end for communication with the intake manifold of the gasoline engine, said throttle body housing means including a throttle body portion and a fuel body portion, said throttle body portion including a base with a first side and an opposed second side and further including an annular rim extending upward from said first side to define said inlet, said base having a pair of spaced apart throttle bores extending from said first side to said second side to define at said second side said outlet means, a throttle valve movably positioned in each of said throttle bores for controlling flow therethrough, said fuel body portion, of open diamond like configuration, includes a first side base, an intermediate injector holder portion and a second side base connected together in spaced apart relationship to each other by a first set of V-shaped support runner legs which are connected at their base ends to first side base and at their opposite spaced apart ends to one side of said injector holder portion and by a second set of V-shaped support runner legs which are connected at its base ends to said second side base and at their opposite spaced apart ends to the opposite side of said injector holder portion whereby said injector holder portion is supported in cantilever fashion relative to said first side of said base, said injector holder portion having a pair of spaced apart socket cavities therein each positioned so as to open at one end above one of said throttle bores, an electromagnetic fuel injector positioned in each of said socket cavities, each said electromagnetic fuel injector having a spray tip at one thereof positioned a predetermined distance above and concentric to an associated one of said throttle bores whereby fuel injected from said spray tip will be discharged against the wall means of said injector holder portion defining the associated one of said throttle bores, each said electromagnetic fuel injector defining with its associated one of said socket cavities a partly enclosed fuel chamber, each said electromagnetic fuel injector having diametrically opposed fuel ports in communication to said fuel chamber with which said electromagnetic fuel injector is associated with, a supply port in said first side base connectable to a low pressure fuel supply conduit, a drain port in said second side base connectable to a fuel drain conduit, inlet passage means in each of said first set of support runner legs with each connected at one end to said supply port and at its opposite ends to an associated said fuel chamber and drain passage means in each of said second set of support runner legs with each connected at one end to said drain port and at their opposite ends to an associated said fuel chamber.

3. A fuel body-injector holder for use in a throttle body injection apparatus having a throttle body that includes a base portion with opposed upper and lower surfaces with an annular rim extending upward from said upper surface to define an inlet passage for induction fluid, said base portion having a pair of spaced apart through throttle bores extending from said upper surface to said lower surface each with a throttle valve operatively positioned therein, said fuel body-injector holder having two sets of V-shaped runner legs in back to back relationship to each other and connected together by an intermediate injector holder means, said injector holder means having two socket cavities therein in predetermined spaced apart relationship to each other so as to be substantially coaxial with said throttle bores, a fuel injector means in each said socket cavity to form therewith an annular fuel chamber, each of said runner legs having a fluid passage means extending therethrough for communication with one of said fuel chambers, the fluid passage means in one set of said runner legs being connectable to a fuel supply conduit and the fluid passage means in the other set of said runner legs being connectable to a fuel drain conduit, each said fuel injector means having a fuel chamber means therein and an inlet port and an outlet port in communication with said fuel chamber means and with the fuel chamber associated with said fuel injector means, and a spray outlet tip positioned for injection of fuel into an associated said throttle bore.

* * * * *